United States Patent [19]

Harootion

[11] 4,441,777

[45] Apr. 10, 1984

[54] ELECTRICALLY SEALED CONNECTOR AND CABLE ASSEMBLY

[75] Inventor: Aramis Harootion, Northridge, Calif.

[73] Assignee: Whittaker Corporation, Los Angeles, Calif.

[21] Appl. No.: 426,325

[22] Filed: Sep. 29, 1982

[51] Int. Cl.[3] ..... H01R 13/52

[52] U.S. Cl. ..... 339/94 M; 339/138; 339/176 M

[58] Field of Search ..... 339/94 R, 94 C, 94 M

[56] References Cited

U.S. PATENT DOCUMENTS

| | | | |
|---|---|---|---|
| 2,281,511 | 4/1942 | Parkin | 339/94 C |
| 2,698,926 | 1/1955 | Young | 339/94 M |
| 2,740,098 | 3/1956 | Phillips | 339/94 R |
| 3,017,597 | 1/1962 | Nava et al. | 339/94 M |
| 3,121,600 | 2/1964 | Healy | 339/136 R |
| 3,158,680 | 11/1964 | Lovitt et al. | 339/94 M |
| 3,474,391 | 10/1969 | Gartzke et al. | 339/138 |
| 3,601,769 | 8/1971 | Oliver et al. | 339/94 M |

*Primary Examiner*—John McQuade
*Attorney, Agent, or Firm*—Donald E. Nist

[57] ABSTRACT

An improved hermetically sealed heat resistant connector and cable assembly is provided which comprises an elongated heat resistant connector body having a central passageway extending throughout the length thereof, a sheathed cable containing a plurality of spaced leads slidably disposed in one end of the passageway with the leads projecting from the cable in the passageway, and a dielectric element in the form of a disc having openings extending therethrough within which the leads are disposed, the element being held in the connector body passageway against the cable. A heat resistant connector plug is slidably disposed in the opposite end of the passageway. The plug has a spaced parallel number of hollow pins extending along the length thereof and aligned with the openings of the dielectric element, the pins receiving the leads as they emerge from the dielectric element. The pins are crimped around the leads for proper connective purposes. Locking nuts are threadably received over opposite ends of the body and a first swaging cone is disposed around the cable between one of the nuts and the adjacent body end. A second swaging cone is disposed around the plug between the second nut and the adjacent body end. The lock nuts and cones hermetically seal the cable and plug in place in the connector body, thus hermetically protecting the cable leads. The assembly is easy to make and has substantial advantages over prior art assemblies with respect to cost, speed and interconnection of components and durability at elevated temperatures in liquid or gaseous environments.

6 Claims, 1 Drawing Figure

ELECTRICALLY SEALED CONNECTOR AND CABLE ASSEMBLY

BACKGROUND OF THE INVENTION

1. Field of the Invention

The present invention generally relates to connectors and more particularly to an improved connector and cable assembly wherein the cable is hermetically sealed to the connector.

2. Prior Art

Temperature measuring devices and the like are frequently employed in equipment which is periodically subjected to extreme conditions of temperature. Thus, for example, thermocouples are extensively utilized in nuclear reactor cores. Although the thermocouples themselves are usually designed to withstand anticipated extreme conditions, considerable difficulties have been encountered with such systems because the connectors used to connect the thermocouples to instrumentation are not capable of withstanding extreme conditions. This was the case with such equipment at the Three-Mile Island nuclear reactor facility. The temperature monitoring and other instrumentation systems become inoperative during the accident which resulted in a loss of coolant.

Conventional connectors characteristically utilized to connect to thermocouple cables and the like comprise plastic components which break down at elevated temperature and/or other components which do no adequately protect the end of the thermocouple from extreme conditions of temperature, humidity and the like. The thermocouples themselves are usually insulated with magnesium oxide or the like and are hydroscopic so that they must be protected against humidity if they are to function under all desired conditions.

Accordingly, there is a need for an improved field installable connector capable of replacing existing connectors for thermocouples and the like cables installed in nuclear reactor and other equipment. Such connectors must be capable of hermetically sealing the thermocouples and resisting elevated temperatures, pressures, corrosion, etc. The connectors must also be designed to be rapidly and conveniently installed on fixed thermocouples, such as those which are imbedded in concrete to form hermetically sealed connections.

SUMMARY OF THE INVENTION

The present invention satisfies all of the foregoing needs. Thus, an improved hermetically sealed heat resistant connector and cable assembly is provided, substantially as set forth in the Abstract above, wherein the cable can be a thermocouple cable or the like. The connection between the end of the cable and an instrumentation plug is hermetically sealed within a connector body so as to be protected against humidity, corrosion, elevated temperature and pressure, etc.

The connector body has a central passageway extending through the length thereof with the cable extending into one end of the passageway and a connector plug extending into the opposite end of the passageway. A dielectric element such as a glass or ceramic disc or the like having openings extending therethrough is positioned against the end of the cable in the connector body passageway and leads from the cable pass through the openings in the dielectric element and extend into hollow pins which form a part of the connector plug. The pins are crimped around the leads. Lock nuts cooperate with swaging cones to hermetically seal the cable and plug to the connector body so that the cable leads are fully protected against humidity, temperature, corrosion, etc.

The dielectric element openings are sloped so as to spread the leads for proper alignment with the plug pins. These pins abut the face of the dielectric element and preferably one of the pins is longer than the other and extends into a recess around one of dielectric element openings so that the correct lead pin orientation is provided. The opposite ends of the pins are capped.

The connector body, nuts, cable sheathing and plug can be fabricated of high temperature corrosion resistant metal or the like and the dielectric element can be of ceramic, glass, etc. Preferably, the cable leads are thermocouples with magnesium oxide disposed therearound to insulate them within the cable sheathing. Various other features of the present invention are set forth in the following detailed description and accompanying drawings.

DRAWINGS

FIG. 1 is a schematic side elevation, largely in cross section and partly broken away, of a preferred embodiment of the improved assembly of the present invention.

DETAILED DESCRIPTION

FIG. 1

Figure 1:
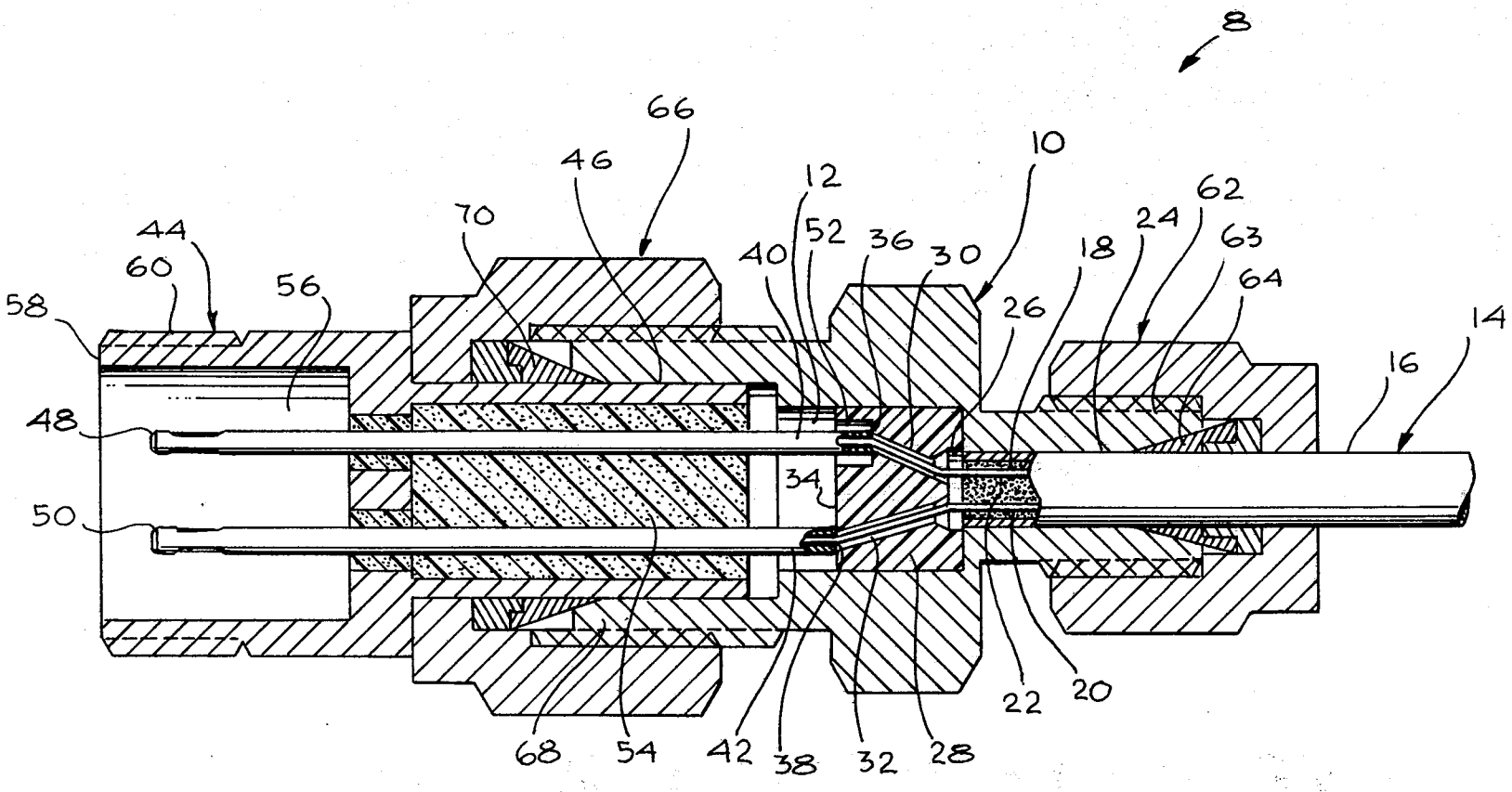

Now referring more particularly to FIG. 1 of the accompanying drawings, an improved assembly in accordance with the present invention is schematically depicted therein, largely in cross section, with portions broken away. Thus, there is provided an assembly 8 which has a connector body 10 which is elongated, is heat resistant and which has a central passageway 12 extending longitudinally therethrough. A cable 14 comprising external heat resistant sheathing 16 and a spaced pair of thermocouple leads 18 and 20 disposed and held in position therein by thermally insulative material 22, such as magnesium oxide which is tightly packed around leads 18 and 20, slidably extends into end 24 of passageway 12.

It will be noted that leads 18 and 20 extend out of cable end 26 in passageway 12 and pass into a disc shaped dielectric element 28, being received within apertures 30 and 32 thereof which extend through element 28. Leads 18 and 20 emerge from the opposite face 34 of element 28 and pass into openings 36 and 38 in pins 40 and 42, respectively, of a connector plug 44 which is slidably disposed within the opposite end 46 of passageway 12. Also as indicated in the single FIGURE, pins 40 and 42 are closed at ends 48 and 50 thereof and are crimped around and tightly grip leads 18 and 20 at the opposite end thereof.

It will be further noted that pin 40 is longer than pin 42 and extends into a recess 52 around opening 30 in face 34 of dielectric element 28. This helps to position plug 44 with respect to alignment of leads 18 and 20. Moreover, this enables the proper pin to be connected to the proper lead from an electrical standpoint. It would be further noted that apertures 30 and 32 are sloped so as to cause leads 18 and 20 to diverge into proper alignment with spaced pins 40 and 42.

Plug 44 may comprise a fired shell of sintered metal or the like. Pins 40 and 42 may comprise, respectively, chromium metal and aluminum metal or the like. Moreover, pins 40 and 42 may be surrounded in plug 44 by component(s) 54 of electrically insulating resin and/or other material such as ceramic material. It will be noted that plug 44 has ends 48 and 50 of pins 40 and 42 exposed within a cavity 56 at one end 58 of assembly 8 for easy connection to measuring devices or the like (not shown). That end 58 may also have a threaded exterior 60 to facilitate interconnection with such instruments.

A first locking nut 62 is releasably threadably received over end 63 of connector body 10 and a swaging cone 64 is disposed in a sloped area between end 63 and nut 62 and over cable 14. Tightening nut 62 on body 10 causes cable 14 to be tightly hermetically sealed within end 24 by swaging cone 64. A second locking nut 66 is releasably threadably disposed over the opposite end 68 of body 10 and a swaging cone 70 is disposed in a sloped area around plug 44 and between end 68 and nut 66. Accordingly, when nut 66 is tightened on body 10, plug 44 is hermetically sealed in place in assembly 8 by swaging cone 70. Thus, cable 14 is fully protected against excess humidity, elevated temperature and pressure and corrosive conditions, particularly at the point where leads 18 and 20 emerge from cable end 26 and pass through dielectric element 28 and into pins 40 and 42.

Connector body 10, shell 44, cable 14, dielectric element 28, nuts 62 and 66 and cones 64 and 70 are very easily assembled together on site to provide improved assembly 8. Thus body 10 with nuts 62 and 66 and cones 64 and 70 loosely in place is usually first slid over the free end of cable 14 to a point where cable end 26 is exposed. Dielectric element 28 is then put in place, with leads 18 and 20 extending therethrough. Next, plug 44 is aligned with leads 18 and 20, leads 18 and 20 are fed into pins 40 and 42 and then those pins are crimped around leads 18 and 20. Body 10 is then slid down into full contact with plug 44 and nuts 62 and 66 are tightened toward each other to form completed assembly 8, with full hermetic protection for leads 18 and 20 and cable end 26.

It will be understood that there can be any number of leads with a commensurate number of plug pins and that the function of cable 14 may be other than as a thermocouple cable. Assembly 8 can be used wherever it is needed to hermetically seal a cable to a connector to protect the cable and connector against damage due to elevated temperature, pressure, corrosion, humidity and the like.

Assembly 8 can be very rapidly put together on site in a few seconds with no tools except a crimping pliers or the like, and pliers or a wrench for nuts 62 and 66, in contrast to greater lengths of time required to replace conventional connectors for nuclear reactor thermocouples and the like. Inasmuch as there usually are numerous thermocouples and the like in a given installation, substantial time and cost can be saved through the use of the present device.

Various other modifications, changes, alterations and additions can be made in the present assembly, and in its components and their parameters. All such modifications, changes, alterations and additions as are within the scope of the appended claims form part of the present invention.

What is claimed is:

1. An improved hermetically sealed heat resistant connector and cable assembly, said assembly comprising, in combination:

a. an elongated heat resistant connector body defining a central longitudinally extending passageway therethrough;

b. a sheathed cable containing a plurality of spaced leads, said cable being slidably disposed in one end of said passageway, said leads projecting from said cable in said passageway;

c. a dielectric element having apertures extending longitudinally therethrough within which are disposed said leads, said element being positioned adjacent said cable in said passageway;

d. a heat resistant connector plug slidably disposed in the opposite end of said passageway from said end containing said cable, said plug having a spaced parallel plurality of hollow pins extending longitudinally therethrough, aligned with said apertures of said dielectric element and receiving said leads; and, e. locking means comprising heat resistant first and second lock nuts threadably releasably connected to opposite ends of said body, a first swaging cone releasably disposed around said cable between said first nut and the adjacent body end and a second swaging cone disposed around said plug between said second nut and the adjacent body end, said lock nuts and swaging cones hermetically sealing said cable and plug in place in said connector body, thus hermetically protecting said cable leads and cable interior.

2. The improved assembly of claim 1, wherein said plug pins are closed on the ends thereof opposite said cable lead-receiving ends.

3. The improved assembly of claim 2, wherein said apertures in said dielectric element diverge to spread said cable leads apart and align them with said pins.

4. The improved assembly of claim 3, wherein the surface of said dielectric element adjacent said pins defines a pin receiving recess around one of said openings to facilitate proper alignment of said pins with said leads.

5. The improved assembly of claim 4, wherein said body, nuts, cable and plug are of metal and said dielectric comprises a ceramic disc.

6. The improved assembly of claim 5 wherein said plug is adapted to connect to a thermocouple of a nuclear reactor core.

* * * * *